United States Patent [19]

Schilling et al.

[11] Patent Number: 5,032,697

[45] Date of Patent: Jul. 16, 1991

[54] ACTUATING DEVICE FOR AN ELECTRICAL SWITCH

[75] Inventors: Jan Schilling, Gechingen; Franz Waschitschek, Sindelfingen; Siegfried Klink, Schönaich; Klaus Endres, Hanau; Norbert Wiesenbach, Hainburg, all of Fed. Rep. of Germany

[73] Assignee: Daimler-Benz AG, Fed. Rep. of Germany

[21] Appl. No.: 431,175

[22] Filed: Nov. 3, 1989

[30] Foreign Application Priority Data

Nov. 4, 1988 [DE] Fed. Rep. of Germany ..... 3837459

[51] Int. Cl.[5] ..... H01H 3/16; H01H 27/06

[52] U.S. Cl. ..... 200/61.62; 200/61.64

[58] Field of Search ..... 200/61.62, 61.64–61.68

[56] References Cited

U.S. PATENT DOCUMENTS 2,077,381 4/1937 Eastman ..... 33/304
2,659,782 11/1953 Wolf ..... 200/61.62
2,956,764 10/1960 Koma ..... 354/293 X
3,005,065 10/1961 Jellies ..... 200/61.62
3,415,961 12/1968 Barnard ..... 200/61.64
3,857,001 12/1974 Quantz ..... 200/61.64
4,101,745 7/1978 Smith ..... 200/61.62 X

FOREIGN PATENT DOCUMENTS 2003204 7/1971 Fed. Rep. of Germany .
3500550 10/1985 Fed. Rep. of Germany .
3725074 9/1988 Fed. Rep. of Germany .

*Primary Examiner*—J. R. Scott
*Attorney, Agent, or Firm*—Evenson, Wands, Edwards, Lenahan & McKeown

[57] ABSTRACT

An actuating device is provided for closing and opening a door or lid lock and correspondingly switching a light on and off during the opening and closing of the door or lid. This actuating device also makes it possible to switch off the light permanently when the door or lid is open, because the switch is switchable indirectly per se as a result of movements of a rotary latch and can be switched manually into its switch-off position independently of the actuating device.

20 Claims, 2 Drawing Sheets

ACTUATING DEVICE FOR AN ELECTRICAL SWITCH

BACKGROUND AND SUMMARY OF THE INVENTION

The invention relates to an actuating device for an electrical switch which switches a light on and off during the opening and closing of a door or lid of a motor-vehicle body. The door or lid is closeable by means of a latch, which provides a mechanism for voluntarily switching the switch into a switch-off position and for keeping it in this switch-off position when the door or lid is open.

An actuating device of this general type can be found in German Offenlegungsschrift 2,003,204. There a pressure switch has an actuating tappet which is longitudinally displaceable and, when the door/lid is closed, is held in a switch-off position with the switch contacts separated and, when the door/lid is open, is brought by spring force into a switch-on position, with the switch contacts connected. That is the generally known functioning of conventional door-lid contact light switches.

To voluntarily switch off a light, switchable on and off by means of the switch contacts, and to relieve the vehicle battery when the door/lid remains open for relatively long periods, the actuating tappet can be pulled out of its switch-position by hand. Then, after overcoming a catch, it assumes a stable third position in which the switch contacts are separated once more. The actuating tappet can be returned to its normal switch-on or switch-off position either by hand, or simply "automatically" as a result of the closing of the door/lid.

There are also vehicles (for example, the VW Passat Variant), in which a boot light is switched on and off as a function of the position of a lock latch by means of an electrical switch assigned to the latch. Here too, it is possible for the light to be switched off voluntarily, with the boot lid open - by bringing the lock latch into a closing position. However, to switch the light on again before the boot lid is closed and to avoid damage at the lock when the boot lid is closed, the outer lock handle then has to be actuated to bring the lock latch again into its release position. An automatic return is not possible.

The object of the invention is to develop the actuating device in such a way that it can be used for a switch which per se is to be switched as a function of positions of a lock latch.

According to the invention, this object is achieved by having a switch-actuating lever acting on the switch in response to an opening and closing of a latch mechanism of the lock into a switch-off position and a switch-on position of the switch and wherein one can voluntarily and independently of the latch move the lever into a stable disengaged position to move the switch into its switch-off position, only when the said latch is in the release position.

It is also advantageous if a driver coupling is provided which couples the switch-actuating lever to movements of the latch and which can be actuated manually to transfer the switch-actuating lever into a stable disengaged position up against a stationary stop and hold it in the disengaged position. The driver coupling is then returnable to an operating position by the latch as it moves into its closing position during the closing of the door or lid. The switch-actuating lever is movably arranged in the lock on a lock carrier and is coupled, via the driver coupling (designed as a bistable catch coupling), to a transmission lever, likewise movably arranged on the lock carrier. The transmission lever is driveable by the lock latch when moved into the closing position. During the voluntary manual transfer of the switch-actuating lever into the disengaged position up against a stop, the catch coupling can be reversed from a first-operational-catch position into a second-disengaged-catch position. When the latch is moved into its closing position, the switch-actuating lever is pressed against the stop by the transmission lever and the catch coupling is returned to the first position again. The transmission lever and the switch-actuating lever are designed as pivoting levers which are mounted on a common shaft axle, fixed to the lock carrier, and which are pivotable through a limited angle $\alpha$ relative to each other. Both the transmission and the switch actuating levers are two-armed. The transmission lever possesses a recess limited by a spring web and the switch-actuating lever possesses a projecting pin, engaging into the recess. The recess forms a limited path of movement for the pin and is arranged at a radial distance from the common shaft of the two levers and extends over the limited angle $\alpha$. The spring web has a catch cam which projects into the recess and by which the first and second catch positions of the catch coupling, or of the pin and of the switch-actuating lever, are defined.

The transmission lever is prestressed resiliently against a buffer, which is fixed to the lock carrier, and against which it rests when the latch is in the release position, and from which it can be lifted off via a lever projection and a nose of the latch moving into its closing position.

It is also advantageous if a take-up structure is provided on the switch-actuating lever for applying the manual disengaging force. A handle with a keyhole, axially aligned with the common pivot shaft is provided on the switch-actuating lever.

A force of a spring prestressing the transmission lever to a switch-on position should be higher than the catching force which can be exerted, in order to reverse the catch coupling when the switch-actuating lever is being transferred into its disengaged position.

Another advantageous structure for the interlock would be to have the switch-actuating lever coupled to the latch itself by a driver coupling to be fixed positively by a detent pawl, disengageable both during the transfer of the switch-actuating lever into its stable disengaged position and during movement of the latch into the closing position. Here the detent pawl, fixing the disengaged position of the switch-actuating lever, is movable together with the latch on the same shaft and is also provided for locking the latch in its closing position. The detent can be returned to its detent position after the release of the latch. Under such an arrangement, the driver coupling possesses a spring which prestresses the switch-actuating lever from the latch towards the detent pawl. This spring is weaker than a spring force prestressing the latch toward its release position and keeping it there. The driver coupling is formed by projections on the latch which are, at least, indirectly in positive contact with the switch-actuating lever. The spring is arranged between an abutment of the switch-actuating lever and one of the projections of the latch and prestresses the switch-actuating lever up against the other projection of the latch towards the release position of the latch. Thus, as a result of the deformation of the spring, the switch-actuating lever can be brought (independently of the latch) into its disengaged position fixed by the detent pawl.

It is also advantageous if the switch-actuating lever is provided with a contour which faces the switch and by means of which the switch is switched into its switch-off position just immediately before the latch returns into its closing position. This preferably occurs when the latch, designed as a rotary latch, is only at an angle of 10° away from its closing position.

It is known (German Offenlegungsschrift 3,500,550) to switch an electrical switch indirectly by a detent pawl as a function of positions of a lock latch. There, the switch is integrated into the control of a central locking system. The detent pawl can be disengaged, counter to a spring force by a lock handle. At the same time as the lock latch is released the switch loaded by the detent pawl, is opened. After the lock handle has been let go, the detent pawl returns to its detent position under the spring force and closes the switch once more. A stable disengaged position of the detent pawl is not provided and would even impair the functioning of the mechanism if provided. In the arrangement according to German Offenlegungsschrift 3,500,550, the switch assumes the same switch (on) position in the two end positions of the lock latch. Only in an intermediate pre-catching position of the detent pawl or the lock latch (which should normally not occur) can it be opened permanently.

In contrast to the general state of the art, in which three switch-contact positions—two "off" and one "on"—are necessary, the actuating device according to the invention can advantageously be combined with a customary two position on/off switch.

In an advantageous development, the disengaged position of the switch-actuating lever, when the lock latch is in the release position, corresponds to its operating position when the latch is in the closing position.

In the actuating device according to the invention, the normal relative position between the switch-actuating lever and the latch can be restored automatically in an especially simple way by closing the door or lid.

Other objects, advantages and novel features of the present invention will become apparent from the following detailed description of the invention when considered in conjunction with the accompanying drawings.

DETAILED DESCRIPTION OF THE DRAWINGS

Figure 1:
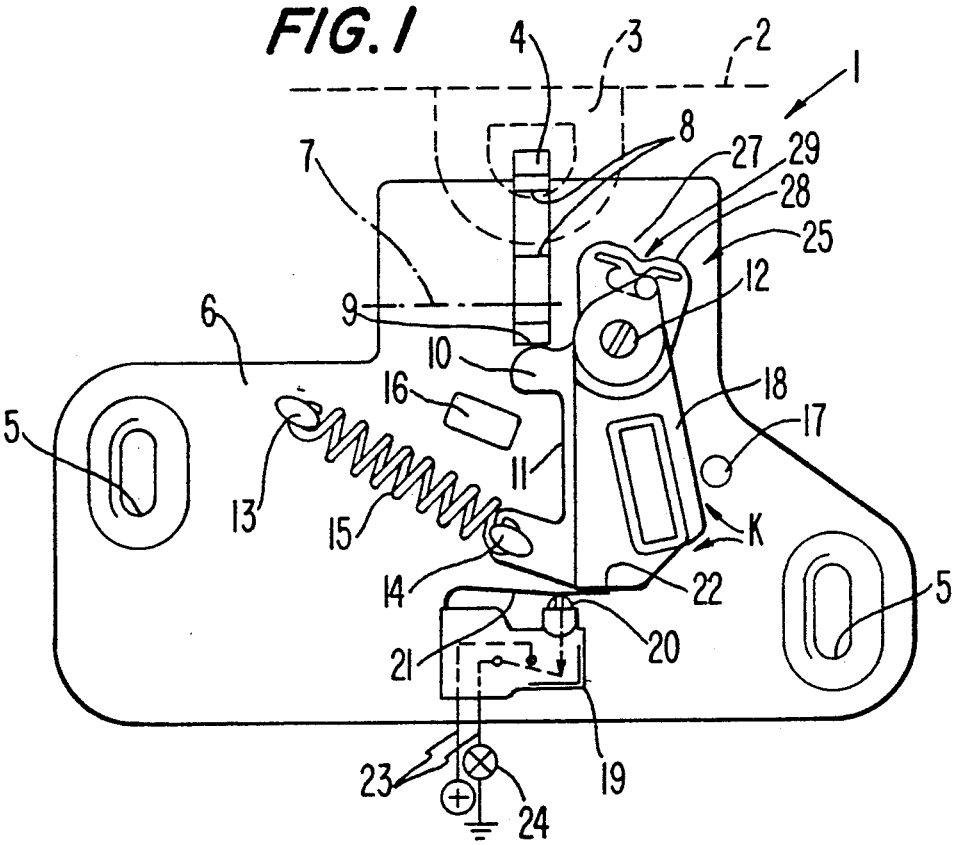
FIG. 1 shows a lid lock with an actuating device according to the invention in a first position.

A lock 1 serves for closing and locking a boot lid 2, (indicated merely by its lower edge represented by a broken line) with a shackle 3 by means of a rotary latch 4.

The rotary latch 4 is pivotably mounted about a shaft 7 in a lock carrier 6 and by means of fastening eyes 5 to the vehicle body. On its outer contour, the latch 4 has a locking jaw 8 for receiving a shackle 3 and a nose 9. In the illustrated closing position of the rotary latch 4, this nose 9 rests on a, lever, projection 10 of a transmission lever 11. The transmission lever is fastened to the lock carrier 6 so as to be pivotable about a shaft 12. The shaft 12 is perpendicular relative to the shaft 7 of the rotary latch 4. The transmission lever 11 is prestressed in the clockwise direction (FIG. 1) by a tension spring 15, fastened to the lock carrier 6 by a hook 13 and to a transmission lever 11 by a hook 14. The lever 11 can swing out in the prestressing direction as far as a buffer 16, fixed to the lock carrier 6. However, it is lifted off from the buffer 16, counter to the force of the spring 15, by the nose 9 of the rotary latch 4 resting on the lever projection 10 of the transmission lever 11. In the position shown in FIG. 1, the transmission lever 11, (right-hand side facing away from the lever projection 10), virtually rests against a stop 17 fixed to the lock carrier 6.

A switch-actuating lever 18 is pivotable about the same axle 12 as, the transmission lever 11 and is coupled to the transmission lever by means of a bistable catch coupling 25. Along an outline K, the two levers 11 and 18 have identical outer contours in a limited region defined approximately by their lower and right-hand edges. The switch-actuating lever 18 consequently also rests against the stop 17 on the right-hand side. Finally, a two-position microswitch 19 is also fastened to the lock carrier 6 and has a vertically displaceable switch tappet 20. A switch spring 21 is fastened to the microswitch 19. During a pivoting movement about the axle 12, the switch-actuating lever 18 can slide on its underside 22 over this switch spring 21, which consists of a sheet-metal strip. In FIG. 1, the rotary latch 4 is in its closing position. The switch spring 21, pressed down by the underside 22 of the switch-actuating lever 18, has displaced the switch tappet 20 of the microswitch 19 downwards and has broken an electrical connection between two leads 23 in the circuit of a light 24.

Figure 2:
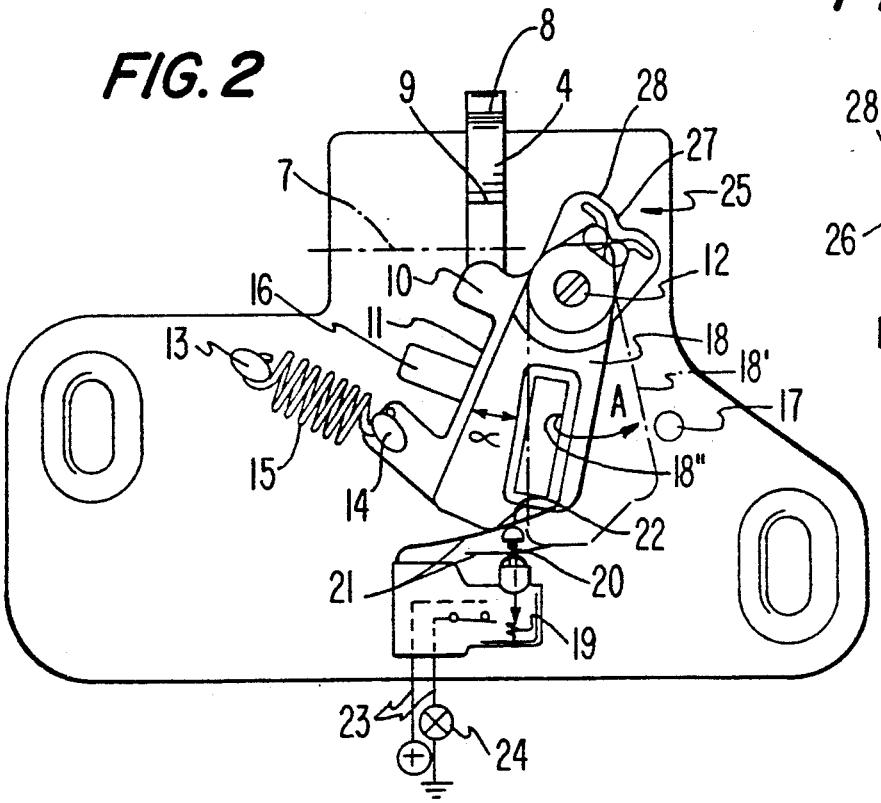
FIG. 2 shows another position of the actuating device, with the disengaged position of the switch-actuating lever indicated.

FIG. 2 shows the normal position of the actuating device which is adopted when the rotary latch 4 is in the release position The boot lid no longer visible here has been opened. The transmission lever 11 is released from the nose 9 of the rotary latch 4 and is now pulled up against the buffer 16 by the spring 15. It has driven the switch-actuating lever 18 in the clockwise direction via the bistable catch coupling 25. Its underside 22 has allowed the switch spring 21 to expand, with the result that the switch tappet 20 of the microswitch 19 has been released and has closed the light circuit via the leads 23.

Now in order to transfer the switch-actuating lever 18 voluntarily into its stable disengaged position 18' (represented by dot-dashed lines and identical to the position of the switch-actuating lever 18 in FIG. 1) a force in the direction of an arrow A can be exerted on it by pivoting through a limited angle $\alpha$. For example, one can apply this force by means of a key, a crank, or one of the user's fingers on a take-up structure 18'' which is designed as a formed contour such as depression, recess or the like. The spring 15 is stronger than the force to be exerted in order to reverse the catch coupling 25, and therefore, at least after the transfer of the switch-actuating lever 18 into the disengaged position 18', the transmission lever 11 maintains the illustrated position unchanged. A further dot-dashed line represents the position of the switch spring 21 after the disengagement of the switch-actuating lever 18 (FIG. 2). It likewise corresponds to the position which is shown in FIG. 1 and in which the microswitch 19 is opened.

To restore the relative position of the two pivoting levers 11 and 18 of FIG. 1, it is merely necessary for the rotary latch 4 to be returned to its closing position by closing the boot lid again. Its nose 9 then comes up against the lever projection 10 and, via this projection 10, pivots the transmission lever 11 in the counter-clockwise direction. The transmission lever presses the switch-actuating lever 18 against the stop 17 via the catch coupling 25 and thereby forces the catch coupling 25 to return to the position according to FIG. 1.

Figure 2A:
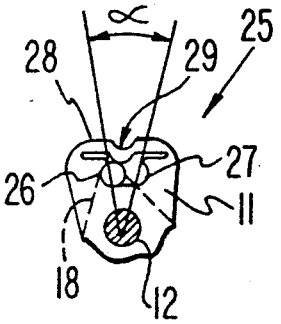
FIG. 2*a* shows a bistable catch coupling as a detail from FIG. 2.

FIG. 2*a* shows a detailed view of the catch coupling 25 from another viewing direction-opposite to FIGS. 1 and 2. The switch-actuating lever 18 (represented by broken lines) reaches into a recess 27 of the transmission lever 11 by means of a perpendicularly projecting pin 26. The recess 27 extends at a constant radial distance from the axle 12 through the angle $\alpha$ and allows the pin 26 to pivot (by the amount of approximately its own diameter or the angle $\alpha$) relative to the transmission lever 11, or in relation to the axle 12. Two stable end positions of the pin-one defining the normal position of the two levers 11 and 18, the other the disengaged position of the switch, actuating lever 18-are defined by a spring web 28 and its cam 29, projecting slightly into the path of movement of the pin 26 within the recess 27. During the reversal of the catch coupling, the catching force of the cam 29 is overcome by its being lifted by means of the pin 26.

Figure 3:
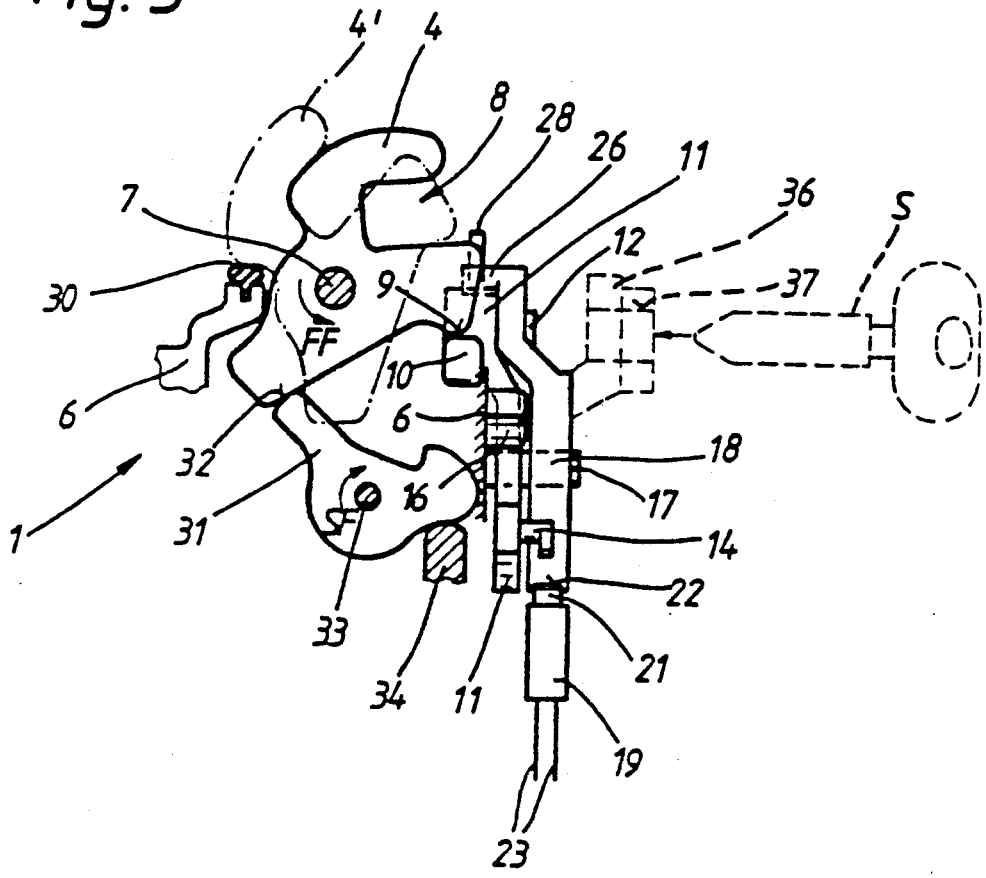
FIG. 3 shows a rotated partial sectional view of the lid lock to illustrate the interaction of the latch with the actuating device.

Finally, FIG. 3 shows a partial sectional view of the lock 1, rotated 90° relative to FIG. 1, in order to illustrate the interaction of the rotary latch with the actuating device. The arrangement of the two levers 11 and 18, pivotable on the same axle 12, in different planes can also be seen clearly here. Components already shown in FIG. 1 bear the same reference symbols.

The rotary latch 4 is represented by unbroken lines in the closing position and by dot-dashed lines in the release position 4'. It is pivotable about the axle 7 and is prestressed in the anti-clockwise direction towards its release position 4' by a torsional spring force FF. In the latter position, it rests against a stop 30, fixed to the lock carrier 6. In the closing position it is retained against a catch 32 by a detent pawl 31. The detent pawl 31 is pivotable about an axle 33, fixed to the lock carrier 6, and is prestressed in the clockwise direction by a torsional spring force SF up against a detent-pawl stop 34, likewise fixed to the lock carrier 6. When the detent pawl 31 is disengaged from the catch 32, counter to the torsional spring force SF, the torsional spring force FF puts the rotary latch 4 into the release position 4'.

It can be seen, furthermore, that only the switch-actuating lever 18 slides with its underside 22 on the switch spring 21 and that only the transmission lever 11 comes into direct contact with the rotary latch 4. Also formed on the switch-actuating lever 18 and represented bY broken lines in FIG. 3 is a handle 36, which has a keyhole 37 axially aligned with the pivot axle 12. By means of a key S which can be inserted into the keyhole 37—for example the vehicle door key —the switch-actuating lever 18 can easily be pivoted by hand. With this arrangement, all that is needed is for a round clearance, in which the handle 36 is received flush in a trim panel for the lock shown.

The scope of protection also includes those versions of the actuating device in which, in contrast to the exemplary embodiment described in detail hitherto, the switch-actuating lever is moved directly by the latch of the lock.

Figure 4:
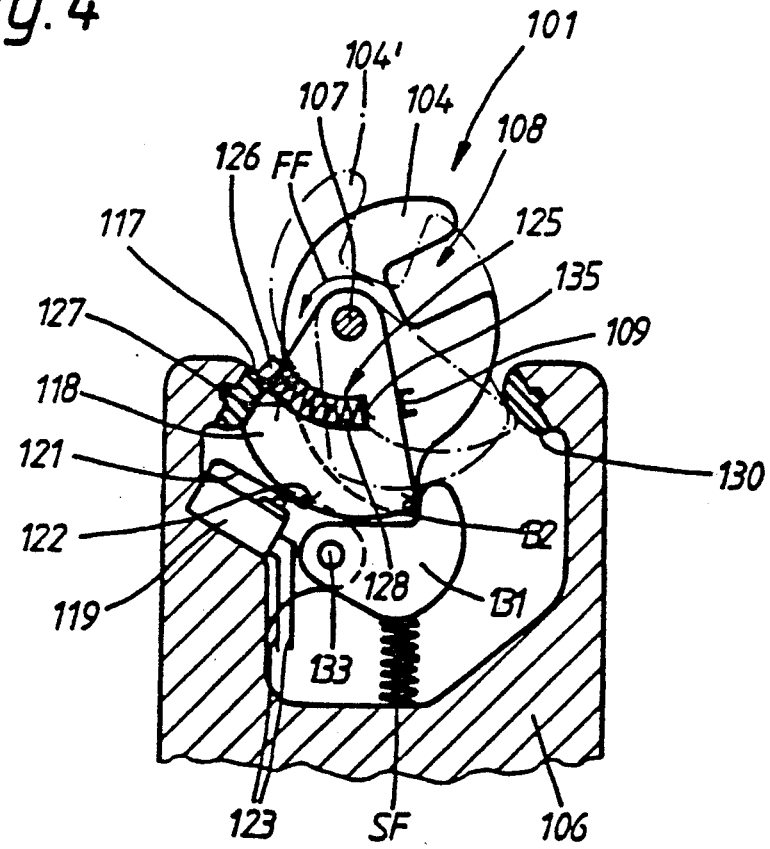
FIG. 4 shows a basic diagram of an alternative version of the actuating device.

FIG. 4 shows a basic diagram of one such different version. Here, the reference numerals are basically counted upwards from "101" using the same last two digits as the previous figures in order to distinguish components functionally identical to those of the preferred first example. Thus, the lock of FIG. 1 is designated by 101 in FIG. 4, the rotary latch 4 of FIG. 1 by 104, the lock carrier 6 of FIG. 1 by 106, the switch-actuating lever 18 in FIG. 1 by 118 in FIG. 4, etc.

The switch-actuating lever 118 is pivotably mounted on the same axle 107 as the rotary latch 104. The rotary latch 104, prestressed in the anti-clockwise direction by the torsional spring force FF, is kept in its closing position against a catch 132 by the detent pawl 131 which pivots around swivel axle 133. The switch-actuating lever 118 also rests against the de 131 by means of the catch 132. With its lower edge 122, it has pressed down the switch spring 121 of the switch 119 and opened the latter. Where the actuation of the switch is concerned, the same functioning emerges from FIG. 4 as from FIGS. 1 and 2.

By pivoting the detent pawl 131 in the clockwise direction counter to the spring force SF by means of a handle (not shown), the catch 132 of the rotary latch 104 and of the switch-actuating lever 118 is released. The two components 104 and 118 are pivoted by the torsional s force FF into their release position 104' indicated by dot-dashed lines whereupon the latch 104 abuts against the stop 130. The lock 101 is opened, and the switch 119 which has leads 123 is closed, because its switch spring 121 is released.

Here, the driver connection 125 is provided, for example, by arranging a compression spring 128 between an angled lug 126 of the rotary latch 104 and one end face 135 of a recess 127 formed in the switch-actuating lever 118 and open towards the lug 126. The recess 127 extends in the form of a ring segment at a constant radial distance round the axle 107 and has a clear width which allows the lug 126 of the rotary latch 104 to be introduced into the recess. The undersides of the rotary latch 104 and of the switch-actuating lever 108 are so formed that the detent pawl 131 returns to its illustrated detent position again when these components 104 and 118, detainable by it, are in the release position. Since the compression spring 128 is substantially weaker than the torsional spring force FF, the switch-actuating lever 118 can once again be transferred into its initial position, represented by unbroken lines a,d up against a stop 117, fixed to the lock carrier corresponding to the stable disengaged position. Independently of the rotary latch 104, the lever 118 is kept in its release position as a result of the torsional spring force FF, by a suitable handle (not shown) which, for example, is likewise arranged at a short axial distance on the axle 107 and is pivotable thereabout. When the compression spring 128 is compressed, the lug 126 enters the recess 127 and the catch 132 of the switch-actuating lever 118 is retained by the detent pawl 131 once more. The switch 119 is opened again.

Instead of the compression spring 128, a torsion spring could also be provided as driver connection between the rotary latch 104 and the switch-actuating lever 118. A weak-catch driver connection can also be used.

Obviously, in this alternative version too, the switch-actuating lever 118 can be brought out of the disengaged position into the release position in the same position as the rotary latch 104, either after renewed actuation of the detent pawl 131 by the spring 128, that is to say simply by actuating the door handle or the like, or by closing the lock 101 exactly in accordance with the first exemplary embodiment.

In the latter operation, the initial position of the two components 104 and 108, which is shown in FIG. 4, is resumed when the rotary latch 104 is once again locked by the detent pawl 131. A nose 109 on the rotary latch 104 drives the switch-actuating lever 118 during pivoting in the clockwise direction, that is to say when the common release position has not been changed by the disengagement of the switch-actuating lever 118 before the lock 101 is closed. When the lock 101 is closed with the switch-actuating lever 118 in the disengaged position, the nose 109 prevents the latter from advancing in the counter-clockwise direction at the moment when the closing rotary latch lifts out the detent pawl 131.

Of course, the scope of protection also embraces actuating devices interacting with linearly displaceably latches.

In addition to the normal use as a light switch, the switch 19 can also be employed to detect unauthorized attempts to gain access. For this, to avoid a false alarm when the lid is not closed firmly enough and opens again automatically, it is advantageous if the switching operation takes place only when the latch immediately precedes the closing position (by approximately 10° where the rotary latch is concerned).

Although the present invention has been described and illustrated in detail, it is to be clearly understood that the same is by way of illustration and example only, and is not to be taken by way of limitation. The spirit and scope of the present invention are to be limited only by the terms of the appended claims.

What is claimed:

1. An actuating device for switching a light on and off during the opening and closing of a door or lid of a motor-vehicle body, comprising:

a latch of a lock in a locking arrangement for holding the door or lid closed;

an electrical switch operatively arranged to be switched at least indirectly into a switch-on position and a switch-off position; and means for voluntarily switching the electrical switch into the switch-off position and for keeping it in the switch-off position when the door or lid is open, including a switch-actuating lever operatively associated with and acting on the electrical switch in response to a closing and a release position of the latch to move the electrical switch into the switch-off position and the switch-on position, respectively and means for shifting the switch-actuating lever independently of the latch, into a stable disengaged position of maintaining the electrical switch in its switch-off position, only when the latch is in the release position.

2. Actuating device according to claim 1, wherein the stable disengaged position of the switch-actuating lever is its position when the latch is in the closing position.

3. Actuating device according to claim 1, wherein the means for voluntarily switching the electrical switch in the switch-off position is returnable into a normal position during the closing of the door or lid by a driver coupling that couples the switch-actuating lever to movements of the latch and which is actuated during a manual transfer of the switch-actuating lever into the stable disengaged position up against a stationary stop to place the switch-actuation lever in a disengaged position; and wherein the driver coupling is returned to an operating position by the latch as it returns into its closing position during the closing of the door or lid.

4. Actuating device according to claim 2, wherein the means for voluntarily switching the electrical switch in the switch-off position is returnable into a normal position during the closing of the door or lid by a driver coupling that couples the switch-actuating lever to movements of the latch and which is actuated during a manual transfer of the switch-actuating lever into the stable disengaged position up against a stationary stop to place the switch-actuating lever in a disengaged position; and wherein the driver coupling is returned to an operating position by the latch as it returns into its closing position during the closing of the door or lid.

5. Actuating device according to claim 3, wherein the switch-actuating lever is arranged movably in the lock on a lock carrier of the locking arrangement and independently of the latch;

said switch-actuating lever being coupled via the driver coupling to a transmission lever;

the driver coupling is a bistable catch coupling;

the transmission lever is movable on the lock carrier of the locking arrangement and driveable by the latch when moved into the closing position;

whereby, during voluntary manual transfer of the switch-actuating lever into the stable disengaged position up against the stop fixed to the lock carrier, the driver coupling can be moved from a first operational catch position into a second disengaged catch position; and when the latch is moved into its closing position, the switch-actuating lever is pressed against the stop by the transmission lever, and the catch coupling is thereby again returned to the operational catch position.

6. Actuating device according to claim 4, wherein the switch-actuating lever is arranged movably in the lock on a lock carrier of the locking arrangement and independently of the latch;

said switch-actuating lever being coupled via the driver coupling to a transmission lever;

the driver coupling is a bistable catch coupling;

the transmission lever is movable on the lock carrier of the locking arrangement and driveable by the latch when moved into the closing position;

whereby, during voluntary manual transfer of the switch-actuating lever into the stable disengaged position up against the stop fixed to the lock carrier, the driver coupling can be moved from a first operational catch position into a second disengaged catch position; and when the latch is moved into its closing position, the switch-actuating lever is pressed against the stop by the transmission lever, and the catch coupling is thereby again returned to the operational catch position.

7. Actuating device according to claim 5, wherein the transmission lever and the switch-actuating lever are each pivotally mounted on a common shaft which is fixed to the lock carrier; and said levers are pivotable through a limited angle $\alpha$ relative to each other.

8. Actuating device according to claim 6, wherein the transmission lever and the switch-actuating lever are each pivotally mounted on a common shaft which is fixed to the lock carrier; and said levers are pivotable through a limited angle $\alpha$ relative to each other.

9. Actuating device according to claim 7, wherein the transmission lever has two arms and a recess limited by a spring web, the switch-actuating lever has two arms and a projecting pin which engages into the recess of the transmission lever;

the recess forms a path of limited movement for the pin and is located at a radial distance from the common shaft of the two levers;

the recess extends over a limited angle $\alpha$ about the common shaft; and the spring web has a catch cam which projects into the recess to define the operational and disengaged catch positions of the driver coupling by location of the pin.

10. Actuating device according to claim 8, wherein the transmission lever has two arms and a recess limited by a spring web, the switch-actuating lever has two arms and a projecting pin which engages into the recess of the transmission lever;

the recess forms a path of limited movement for the pin and is located at a radial distance from the common shaft of the two levers;

the recess extends over a limited angle $\alpha$ about the common shaft; and the spring web has a catch cam which projects into the recess to define the operational and disengaged catch positions of the driver coupling by location of the pin.

11. Actuating device according to claim 5, wherein the transmission lever is prestressed resiliently against a buffer which is fixed to the lock carrier and against which the transmission lever rests when the latch is in the release position; and the transmission lever is lifted off the buffer by a lever projection engaging a nose of the latch as the latch moves into its closing position.

12. Actuating device according to claim 1, wherein the switch-actuating lever is provided with a formed contour for applying a voluntary force to shift the switch-actuating lever.

13. Actuating device according to claim 7, wherein a handle with a keyhole, axially aligned with the common pivot shaft is provided on the switch-actuating lever.

14. Actuating device according to claim 9, wherein a spring prestresses the transmission lever into a position to move the switch actuating lever into a position to actuate the electric switch with a force that is higher than a catching force exerted by the catch coupling in order to reverse the catch coupling when the switch-actuating lever is being transferred into its stable disengaged position.

15. Actuating device according to claim 1, wherein the switching-actuating lever is operatively coupled to the latch via a driver connection and is fixed in the stable disengaged position positively fixed by a detent pawl which is disengaged both during the voluntary transfer of the switch-actuating lever into the stable disengaged position and during movement of the latch into the closing position.

16. Actuating device according to claim 15, wherein the detent paul locking the switch-actuating lever movable on a common axis with the latch in the stable disengaged position also lock the latch in its closing position; and wherein the detent pawl is returned to a detent position after the release of the latch means.

17. Actuating device according to claim 15, wherein the catch coupling includes a first spring which prestresses the switch-actuating lever from the latch towards the detent pawl, and a second spring stronger than the first spring and the prestresses the latch towards the release position and keeps the latch in the release position.

18. Actuating device according to claim 11, wherein the coupling is formed by projections on the latch which come into positive contact with the switch-actuating lever means.

19. Actuating device according to claim 18, wherein the spring is arranged between an abutment on the switch-actuating lever and one of the projections on the latch;

the spring prestresses the switch-actuating lever against the other projection on the latch towards the release position of the latch; and as a result of a deformation of the spring, the switch-actuating lever can be brought, independently of the latch, into its disengaged position fixed by the detent pawl.

20. Actuating device according to claim 1, wherein the switch-actuating lever is provided with a contour which faces the electric switch to move the electric switch into its switch-off position immediately before the latch moves into its closing position; and the latch is a rotary latch and the contour moves the electric switch when the rotary latch is only an angle of 10° away from its closing position.

* * * * *